US005148794A

United States Patent [19]

Scouten

[11] Patent Number: 5,148,794

[45] Date of Patent: * Sep. 22, 1992

[54] FUEL AGITATING DEVICE FOR INTERNAL COMBUSTION ENGINE

[76] Inventor: Douglas G. Scouten, 2665 Spring St., Niagara Falls, N.Y. 14305

[ * ] Notice: The portion of the term of this patent subsequent to Dec. 3, 2008 has been disclaimed.

[21] Appl. No.: 795,520

[22] Filed: Nov. 21, 1991

Related U.S. Application Data

[63] Continuation-in-part of Ser. No. 547,806, Jul. 2, 1990, Pat. No. 5,069,191.

[51] Int. Cl.[5] ..... F02M 33/00

[52] U.S. Cl. ..... 123/538; 123/536; 123/537

[58] Field of Search ..... 123/538, 537, 536; 138/37

[56] References Cited

U.S. PATENT DOCUMENTS

| | | | |
|---|---|---|---|
| 4,237,836 | 12/1980 | Tanasawa et al. | 123/537 |
| 4,251,031 | 2/1981 | Martin et al. | 123/538 |
| 4,590,915 | 5/1986 | Yamauchi et al. | 123/538 |
| 4,930,483 | 6/1990 | Jones | 123/538 |
| 5,069,191 | 12/1991 | Scouten | 123/538 |

*Primary Examiner*—Willis R. Wolfe
*Assistant Examiner*—M. Macy
*Attorney, Agent, or Firm*—Joseph P. Gastel

[57] ABSTRACT

A fuel agitating device for an internal combustion engine including a casing, an inlet conduit in the casing, an outlet conduit in the casing, a chamber between the inlet and outlet conduits, a divider in the chamber between the inlet conduit and the outlet conduit, and a slotted flanged member located in coaxial relationship to the outlet conduit and located between the divider and the outlet conduit.

16 Claims, 3 Drawing Sheets

FUEL AGITATING DEVICE FOR INTERNAL COMBUSTION ENGINE

CROSS REFERENCE TO RELATED APPLICATION

The present application is a continuation-in-part of application Ser. No. 547,806, filed July 2, 1990, now U.S. Pat. No. 5,069,191 issued Dec. 3, 1991.

BACKGROUND OF THE INVENTION

The present invention relates to a fuel agitating device for supplying fuel to an internal combustion engine in such a manner that it causes the engine emissions of carbon monoxide and hydrocarbon to be substantially reduced.

It is well known that internal combustion engines emit pollutants, namely, carbon monoxide and hydrocarbons. It is with a device which reduces the emissions of carbon monoxide and hydrocarbons that the present invention is concerned.

SUMMARY OF THE INVENTION

It is one object of the present invention to provide a fuel agitating device for an internal combustion engine which can be retrofitted into an existing fuel inlet line and which will cause the carbon monoxide and hydrocarbon emissions from the engine to be substantially reduced.

Another object of the present invention is to provide a fuel agitating device which achieves the foregoing objects and which can be fabricated by simple machining operations. Other objects and attendant advantages of the present invention will readily be perceived hereafter.

The present invention relates to an agitator for fuel being conducted to an internal combustion engine comprising a casing, a fuel inlet conduit in said casing, a fuel outlet conduit in said casing, a chamber within said casing between said fuel inlet conduit and said fuel outlet conduit, said flow divider means in said chamber for dividing said chamber into a plurality of fuel flow paths on opposite sides thereof, an inner wall in said casing defining said exit portion, flange means in said casing within said chamber and spaced radially inwardly from said inner wall, and conduit means within said flange means for conducting fuel to said outlet conduit.

The various aspects of the present invention will be more fully understood when the following portions of the specification are read in conjunction with the accompanying drawings wherein:

DESCRIPTION OF THE PREFERRED EMBODIMENTS

Figures 1, 2, 3, 4, 5, 6:
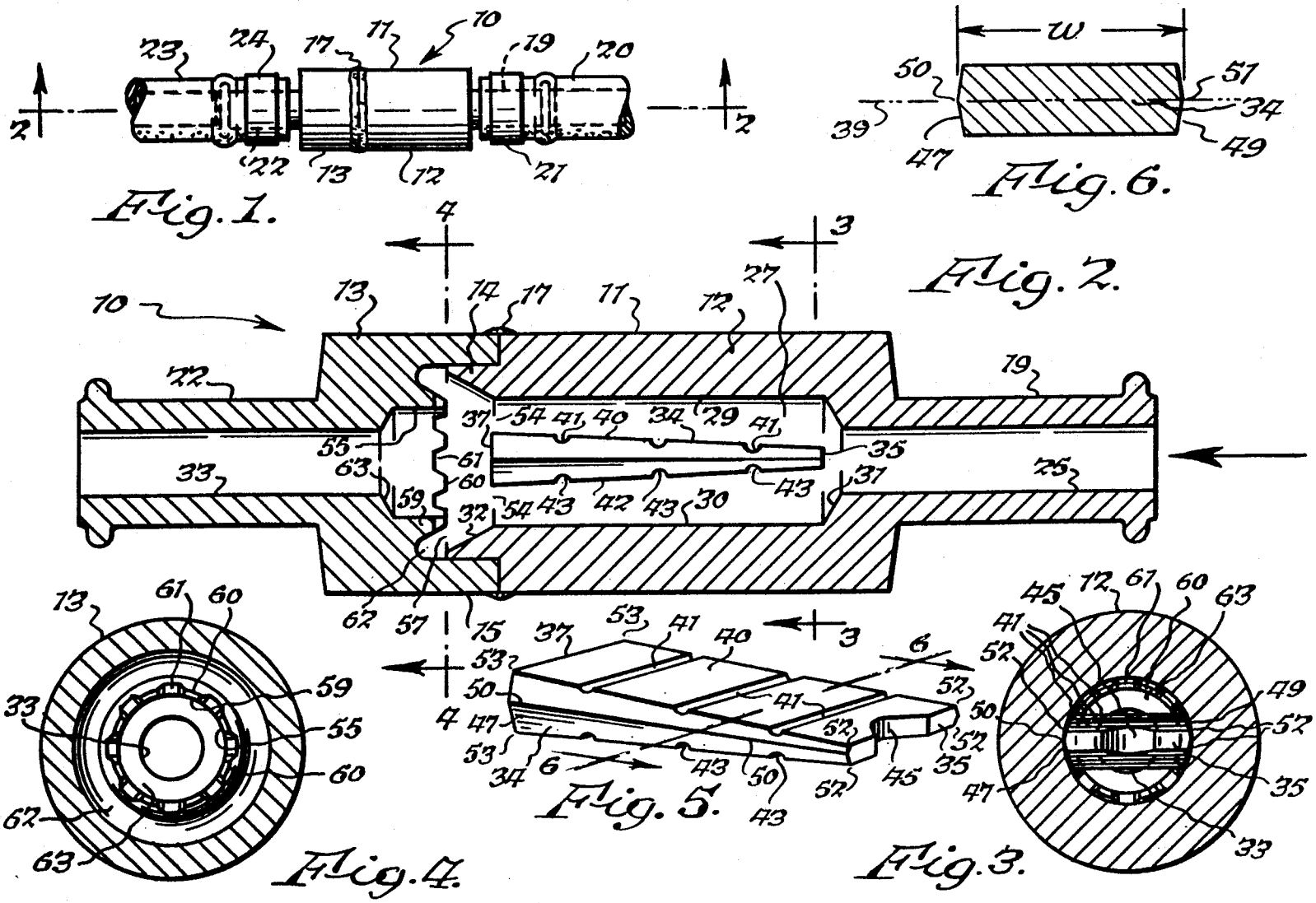
FIG. 1 is a fragmentary plan view of the fuel agitating device of the present invention.
FIG. 2 is an enlarged cross sectional view taken substantially along line 2—2 of FIG. 1.
FIG. 3 is a cross sectional view taken substantially along line 3—3 of FIG. 2.
FIG. 4 is a cross sectional view taken substantially along line 4—4 of FIG. 2.
FIG. 5 is a perspective view of the insert within the housing of the unit.
FIG. 6 is a cross sectional view taken substantially along line 6—6 of FIG. 5.

Summarizing in advance, the fuel agitating device 10 of the present invention is intended to cause fuel supplied to a gasoline engine to be burned more efficiently by causing the emissions of carbon monoxide and hydrocarbons to be substantially reduced.

The fuel agitating device 10 of FIGS. 1–6 includes a casing 11 which is fabricated in two parts, namely, inlet portion 12 and outlet portion 13. Inlet portion 12 terminates at annular flange 14 which is received with a sliding fit within annular end 15 of outlet portion 13. Inlet portion 12 and outlet portion 13 are secured to each other by an annular weld 17. Inlet portion 12 includes a nipple extension 19 onto which a gasoline conduit 20 is mounted and secured thereto by hose clamp 21. Outlet portion 13 includes an outlet nipple 22 on which hose 23 is mounted and secured thereto by hose clamp 24. Conduit 25 in nipple extension 19 leads into chamber 27 which is defined in part by wall 29 which includes a cylindrical portion 30, a frustoconical portion 31 proximate conduit 25 and a flared-out portion 32. Conduit 33 in outlet nipple 22 is in communication with the portion of chamber 27 adjacent thereto. Thus, chamber 27 includes an entry portion adjacent inlet conduit 25, an exit portion adjacent outlet conduit 33, and a central portion therebetween. The outlet of casing 11 should be as close as possible to the carburetor or fuel injector and preferably not more than 6 inches therefrom.

A wedge-like member 34, which has a narrow end 35 and a wide end 37, is located in chamber 27. It is symmetrical along a central longitudinal plane 39 (FIG. 6). It has an upper surface 40 with a plurality of grooves 41 therein and a lower surface 42 with a plurality of grooves 43 therein. The narrow end 35 of wedge 34 has a curved cutout 45 therein so that end 35 does not unduly obstruct the end of conduit 25. Wedge-like member 34 has V-shaped side walls 47 and 49 which terminate at edges 50 and 51, respectively. Wedge 34 is self-centering during its insertion into chamber 27, and it thus divides chamber 27 into two equal portions in its installed position. In this respect, the width w between edges 50 and 51 is uniform throughout the length of wedge 34 and the width w is a few thousandths of an inch larger than the interal diameter of cylindrical portion 30. Wedge 34 is driven into the position shown. Since wedge 34 is made of a material which is harder than brass, in this instance hardened aluminum, and since casing 11 is made of brass, the edges 50 and 51 of wedge 34 will form mating grooves in wall 29 as they contact it while wedge 34 is being driven into position.

Ends 35 and 37 are preferably dimensioned so that their corners 52 and 53, respectively, engage wall 29, or at least are very close thereto.

The volume of chamber 27 immediately adjacent the outlet of conduit 25 is greater than the cross sectional area of the latter, and therefore the fuel will slow down when it enters frustoconical portion 31 and the adjacent portion of chamber 27. In addition, as it hits the end 35 and curved cutout 45, the fuel will become agitated. It will also be agitated as it passes along surfaces 40 and 42. Furthermore as the fuel passes toward outlet nipple 22 through the spaces between the cylinder wall 29 and wedge surfaces 40 and 42, the fuel will increase in velocity because the volume of chamber 27 is constricted by wedge 34.

After the fuel leaves the spaces 54 on the opposite sides of wedge end 35, it enters a chamber portion of larger volume defined by frustoconical portion 32, and thus there is a decrease in the velocity of the fuel. A portion of the fuel then directly enters cylindrical duct 55 which leads to conduit 33 in nipple 22. Another portion of the fuel passes through annular throat 57 between frustoconical surface 32 and flange 59, which is of an interrupted shape having ridges 60 and slots or grooves 61 therebetween. It then passes into annular dead end chamber 62 from which it bounces back through the slots 61 between ridges 60, which form the flange 59 of interrupted shape, and the fuel thereafter enters the conduit 55 leading to frustoconical portion 63 which is adjacent to nipple conduit 33. Thus, the fuel passing through slots 61 and passing by ridges 60 becomes agitated, and, as it passes through frustoconical portion 63, it increases in velocity.

It is believed that the agitation and mixing action of the fuel causes violent molecular vibrations leading to a greater displacement of the atoms from their equilibrium lattice positions thereby placing the fuel, which is still in a liquid state, close to a vapor state, but ready to be vaporized in the engine. It is believed that this action causes the engine to operate much more efficiently and thus lowering the exhaust emissions of carbon monoxide and hydrocarbons.

In actual tests, the following results were observed when the agitating device 10 of the present invention was installed on a 1989 Plymouth 4-door sedan having a 2.2 liter 4-cylinder engine:

| | EMISSION TEST | |
|---|---|---|
| | CO EMISSION | HYDROCARBON EMISSION |
| | WITHOUT AGITATOR | |
| LOW RPM | .34% | 236 PPM |
| HIGH RPM | .16% | 217 PPM |
| | WITH AGITATOR | |
| LOW RPM | .03% | 5 PPM |
| HIGH RPM | .00% | 3 PPM |

The drawings in FIGS. 1–6 are to scale. In the device shown in the drawings chamber 27 is 5/16 of an inch in diameter. It will be appreciated that the other parts are of a proportional size. It will also be appreciated that departures can be made from the above noted measurements within the scope of the present invention.

Figure 7:
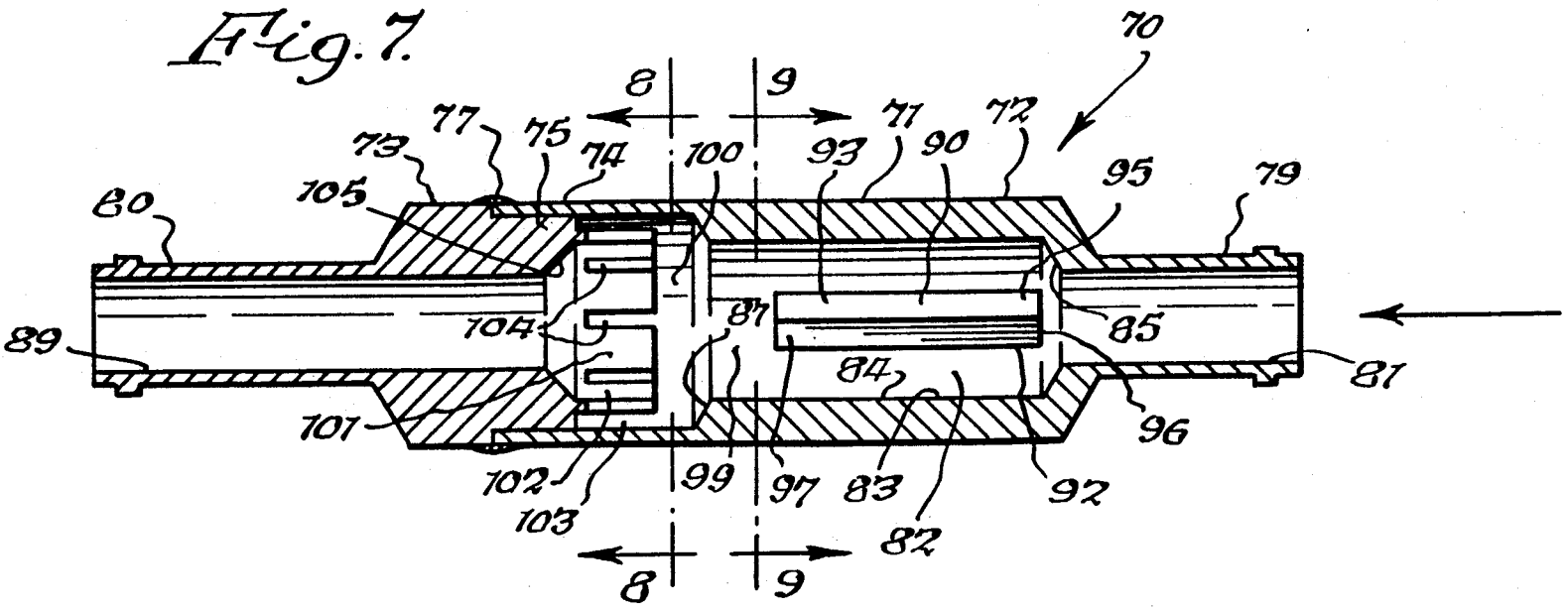
FIG. 7 is a cross sectional view taken substantially along line 7—7 of FIG. 8 of another embodiment of a fuel agitating device.
Figure 9:
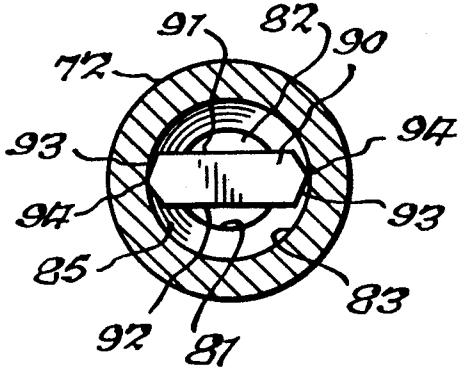
FIG. 9 is a cross sectional view taken substantially along line 9—9 of FIG. 7.
Figure 8:
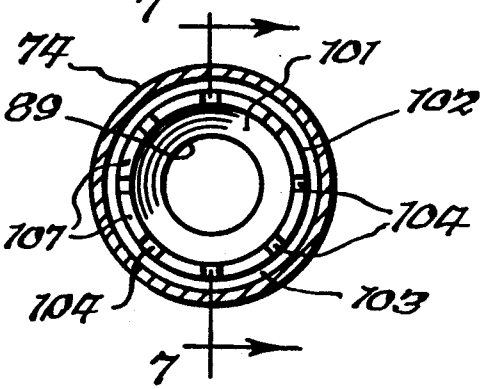
FIG. 8 is a cross sectional view taken substantially along line 8—8 of FIG. 7.

In FIGS. 7–9 another embodiment of the present invention is shown. The fuel agitating device 70 includes a casing 71 which is fabricated in two parts, namely, inlet portion 72 and outlet portion 73. Inlet portion 72 terminates at annular flange 74 which receives annular portion 75 of outlet portion 73 with a sliding fit. Inlet portion 72 and outlet portion 73 are secured to each other by annular weld 77. Inlet portion 72 includes a nipple extension 79 onto which a gasoline conduit, such as 20 of FIG. 1, is mounted and secured thereto by a suitable hose clamp. Outlet portion 73 includes an outlet nipple 80 onto which a hose, such as 23 of FIG. 1, is mounted and secured thereto by a suitable hose clamp. Conduit 81 in nipple extension 79 leads into a chamber 82 which is defined in part by a wall 83 which includes a cylindrical portion 84, a frustoconical portion 85 proximate inlet conduit 81, and a flared out portion 87. Conduit 89 in outlet nipple 80 is in communication with the portion of chamber 82 adjacent thereto. Thus, chamber 82 includes an entry portion adjacent inlet conduit 81, an exit portion adjacent outlet conduit 89, and a central portion therebetween. Preferably the outlet of casing 71 should be as close as possible to the carburetor or fuel injector of the engine.

A flow divider 90 is of substantially rectangular solid configuration and it has an upper surface 91, a lower surface 92 and side edges 93 which are preferably chamfered as shown so as to come to points 94. Divider 90 is driven into the position shown with an interference fit so that it divides the portion of chamber 82 in which it is located into substantially equal parts on the opposite sides thereof. Divider 90 has its end portion 95 in the entry portion of chamber 82 and it has its end portion 97 in the central portion of chamber 82. If desired, divider 90 may be more of a solid rectangular shape without beveled edges 93 but with the corners of side edges 93 chamfered. Divider 90 is self-centering during its insertion into chamber 82.

The volume of chamber 82 immediately adjacent the outlet of conduit 81 is greater than the cross sectional area of the latter, and therefore fuel will slow down when it enters the frustoconical portion 85 and the adjacent portion of chamber 82. In addition, as it hits the end portion 95 the fuel will become agitated. The end surface 96 is of the same shape as the end surface of divider 90 shown in FIG. 9. The fuel will also be agitated as it passes through the portions of chamber 82 on opposite sides of divider 90.

After the fuel leaves the spaces on the opposite sides of divider 90, it enters portion 99 of chamber 82 where it decreases in velocity, and it thereafter enters enlarged portion 100 of chamber 82 and there is a further decrease in the velocity of the fuel. A portion of the fuel then directly enters the area 101 within slotted flange 102 which leads to conduit 89 in nipple 80. Another portion of the fuel enters the annular space 103 between flange 102 and portion 74 of casing 71 and thereafter passes through slots 104 of flange 102. The fuel thereafter passes through frustoconical portion 105 and into conduit 89. Thus, the fuel passing through slots 104 and passing against the ends 107 of flange 102 becomes agitated, and, as it passes through the frustoconical portion 105, it increases in velocity.

It has been found that models made in accordance with the structure of FIGS. 7–9 work effectively toward reducing exhaust emissions of carbon monoxide and hydrocarbons from gasoline engines.

Figure 10:
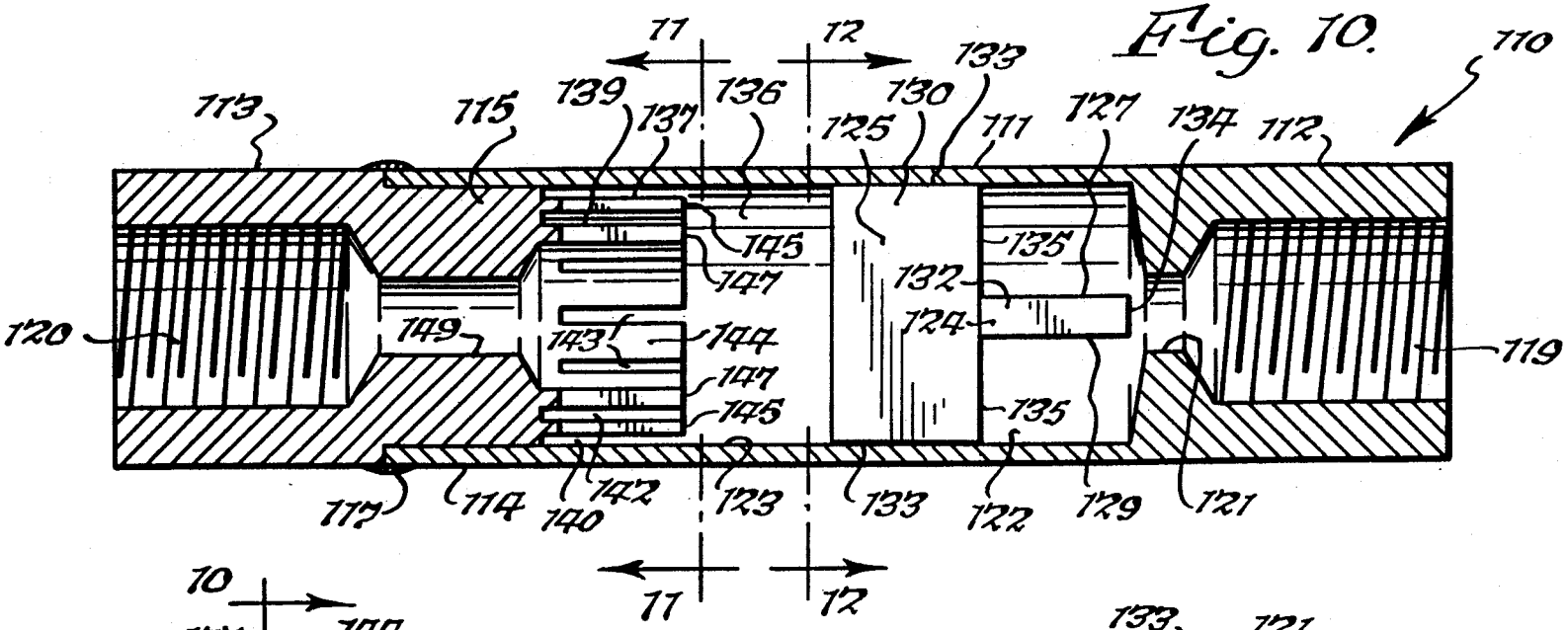
FIG. 10 is a cross sectional view taken substantially along line 10—10 of FIG. 11 and showing yet another embodiment of the agitating device of the present invention.
Figure 12:
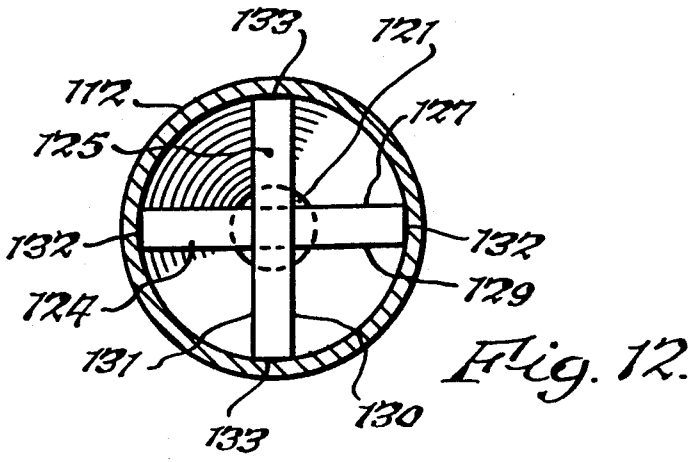
FIG. 12 is a cross sectional view taken substantially along line 12—12 of FIG. 10.
Figure 11:
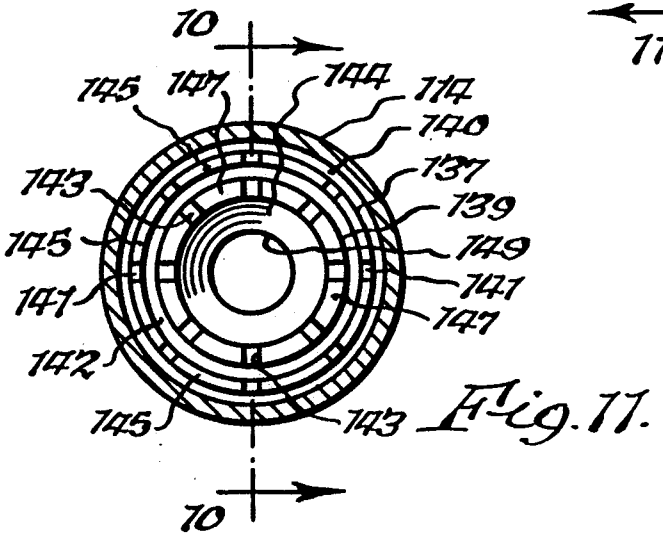
FIG. 11 is a cross sectional view taken substantially along line 11—11 of FIG. 10.

In FIGS. 10–12 a still further embodiment is shown for use in diesel engines. The fuel agitating device 110 includes a casing 111 which is fabricated in two parts, namely, inlet portion 112 and outlet portion 113. Inlet portion 112 terminates at annular portion 114 which receives annular portion 115 of outlet portion 113 with a sliding fit. Inlet portion 112 and outlet portion 113 are secured to each other by an annular weld 117. Inlet portion 112 includes an internally threaded portion 119 for connection to a threaded end of an inlet fuel conduit. Outlet portion 113 includes an internally threaded portion 120 for connecting to an outlet fuel conduit. Proximate threaded portion 119 is a reduced cylindrical portion 121 which leads to chamber 122 which is defined by cylindrical wall 123. Chamber 122 includes an entry portion proximate reduced opening 121, an exit portion at the opposite end of chamber 122 and a central portion therebetween.

A pair of plate-like divider members 124 and 125 are located in chamber 122. Divider 124 is located closer to the entry portion and divider 125 is located closer to the central portion of chamber 122. Dividers 124 and 125 are of substantially solid rectangular configuration. Divider 124 has opposite surfaces 127 and 129 and divider 125 has opposite surfaces 130 and 131. Divider 124 has side edges 132 and divider 125 has side edges 133. Dividers 124 and 125 are pressed into the position shown in FIG. 10 with an interference fit so that they will retain their positions therein. As the fuel flows through opening 121, it impinges on end edge 134 of divider 124 and becomes agitated. Thereafter, it expands as it is divided to flow into the portions of chamber 122 on opposite sides of divider 124. The fuel is further agitated as it impinges on edges 135 of divider 125. Thereafter, the fuel is divided into two portions as it flows into the portions of chamber 122 on opposite sides of divider 125. Thereafter, the fuel expands as it flows into chamber portion 136. The edges 134 and 135 are substantially in the shape of rectangles, as can be visualized from FIG. 12 wherein the opposite sides of dividers 124 and 125 are shown.

After the fuel leaves chamber portion 136, a portion of the fuel passes through the inside area 144 defined by concentric cylindrical flanges 137 and 139 which are formed integrally at the inner end of portion 115 of casing portion 113. Another portion of the fuel enters annular chamber 140 on the outside of annular flange 137. This portion then passes through the numerous circumferentially spaced slots 141 in annular flange 137 and then enters annular chamber 142 between annular flange 137 and 139. This portion of the fuel thereafter passes through the numerous circumferentially spaced slots 143 in annular flange 139 and then it passes into the area 144 within annular flange 139. The portion of the fuel passing through slots 141 and 143 is severely agitated. Also the portions of the fuel which impinge on ends 145 of flange 137 and on the ends 147 of flange 139 are also agitated before passing into the area 144 within flange 139. The agitated fuel then passes through reduced conduit 149 within outlet portion 113. The increasing and decreasing of volume within the agitator 110 along with the impingement of the fuel along the edges of dividers 124 and 125 and the impingement of the fuel on the ends 145 and 147 of the flanges 137 and 139, respectively, and the passage of the fuel through the slots 141 and 143 of the flanges 137 and 139, respectively, and through the annular spaces 140 and 142 is believed to cause the severe agitation which results in the diesel engine operating more efficiently and thus lowering the exhaust emissions of carbon monoxide and hydrocarbons. The embodiment of FIGS. 10–12 has been tested successfully on diesel engines.

While preferred embodiments of the present invention has been disclosed, it will be appreciated that it is not limited thereto but may be otherwise embodied within the scope of the following claims.

What is claimed is:

1. An agitator for fuel being conducted to an internal combustion engine comprising a casing, a fuel inlet conduit in said casing, a fuel outlet conduit in said casing, a chamber within said casing between said fuel inlet conduit and said fuel outlet conduit, flow divider means in said chamber for dividing said chamber into a plurality of fuel flow paths on opposite sides thereof, an inner wall in said casing defining said exit portion, flange means in said casing within said chamber and spaced radially inwardly from said inner wall, and conduit means within said flange means for conducting fuel to said outlet conduit.

2. An agitator as set forth in claim 1 wherein said chamber includes an entry portion proximate said fuel inlet conduit and an exit portion proximate said fuel outlet conduit and a central portion between said entry portion and said exit portion, and wherein said divider means is located in said entry and central portions of said chamber.

3. An agitator as set forth in claim 1 wherein said flow divider means comprises at least one member extending axially of said casing.

4. An agitator as set forth in claim 3 wherein said chamber includes an entry portion proximate said fuel inlet conduit and an exit portion proximate said fuel outlet conduit and a central portion between said entry portion and said exit portion, and wherein said divider means divides said entry portion and said central portion into substantially equal portions.

5. An agitator as set forth in claim 3 wherein said divider means comprises a first plate-like member closer to said entry portion, and a second plate-like member closer to said exit portion and extending transversely to said first plate-like member.

6. An agitator as set forth in claim 5 wherein said flange means comprise outer flange means proximate said inner wall, and inner flange means on the opposite side of said outer flange means from said inner wall.

7. An agitator as set forth in claim 6 wherein said outer and inner flange means are slotted.

8. An agitator as set forth in claim 3 wherein said flange means comprise outer flange means proximate said inner wall, and inner flange means on the opposite side of said outer flange means from said inner wall.

9. An agitator as set forth in claim 8 wherein said outer and inner flange means are slotted.

10. An agitator as set forth in claim 1 including opposite sides on said divider means, and groove means on at least one of said opposite sides.

11. An agitator as set forth in claim 10 including groove means on both of said opposite sides extending crosswise of said divider means.

12. An agitator as set forth in claim 11 wherein said groove means comprise a plurality of grooves on each of said opposite sides.

13. An agitator as set forth in claim 1 wherein said flange means comprise a plurality of spaced members with slots therebetween.

14. An agitator as set forth in claim 1 wherein said exit portion includes a portion which flares outwardly from said central portion.

15. An agitator as set forth in claim 1 wherein said flange means is located radially inwardly of a dead end chamber proximate said exit portion.

16. An agitator as set forth in claim 15 wherein said flange means comprise a plurality of spaced members with slots therebetween.

* * * * *